United States Patent [19]

Alder et al.

[11] Patent Number: 4,596,947

[45] Date of Patent: Jun. 24, 1986

[54] POWER CONTROL CIRCUIT ARRANGEMENTS

[75] Inventors: John M. Alder, Botley; Robert S. Ireland, Thornhill, both of England

[73] Assignee: Plessey Overseas Ltd., Ilford, England

[21] Appl. No.: 533,599

[22] Filed: Sep. 19, 1983

[30] Foreign Application Priority Data

Sep. 20, 1982 [GB] United Kingdom ..... 8226714

[51] Int. Cl.[4] ..... G05F 1/455

[52] U.S. Cl. ..... 323/243; 323/246

[58] Field of Search ..... 323/239, 241, 242, 243, 323/246, 300; 219/490, 492, 497, 499, 501

[56] References Cited

U.S. PATENT DOCUMENTS

| | | | |
|---|---|---|---|
| 3,723,854 | 3/1973 | Kita | 323/246 |
| 4,039,897 | 8/1977 | Dragoset | 323/243 X |
| 4,146,830 | 3/1979 | Foster | 323/246 X |
| 4,287,468 | 9/1981 | Sherman | 323/322 |
| 4,356,433 | 10/1982 | Linden | 323/246 X |
| 4,426,614 | 1/1984 | Nola | 323/246 X |

FOREIGN PATENT DOCUMENTS

| | | | |
|---|---|---|---|
| 2041673 | 9/1980 | United Kingdom | 323/322 |

*Primary Examiner*—Peter S. Wong

*Attorney, Agent, or Firm*—Fleit, Jacobson, Cohn & Price

[57] ABSTRACT

A power control circuit in which a direct current voltage (Vp) proportional to the a.c. power applied to a load (L) is derived from voltages (Vc and Vv) proportional to the a.c. current flowing in the load (L) and the a.c. voltage across the load, respectively, and compared with a voltage (Vnp) representing nominal power to the load to provide a d.c. signal (Vd) the amplitude of which is utilized in conjunction with a staircase or ramp generator (SG) to add or deduct cycles of the a.c. power to or from the load circuit according to a predetermined load power rating and in dependence upon variations in the a.c. supply voltage to the load and changes in resistance of the load.

3 Claims, 1 Drawing Figure

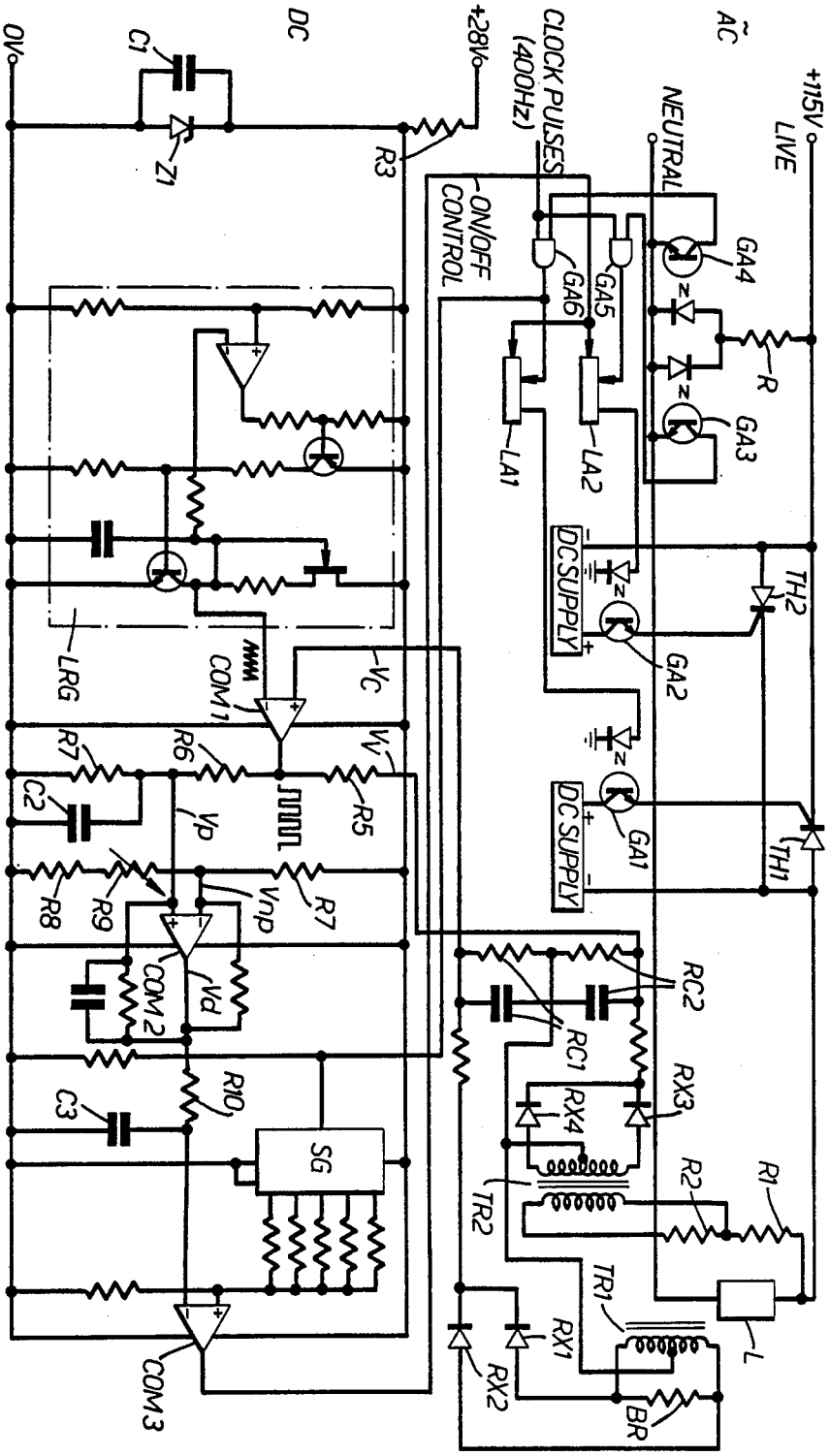
+115V
LIVE
AC
NEUTRAL
CLOCK PULSES
(400Hz)
+28V
DC
0V
ON/OFF
CONTROL
GA4
GA3
R
GA6
GA5
LA1
LA2
DC SUPPLY
DC SUPPLY
GA2
GA1
TH2
TH1
C1
Z1
R3
LRG
COM1
Vc
Vv
R7
R6
R5
C2
Vp
R8
R9
VnP
R7
COM2
Vd
R10
C3
SG
COM3
RC2
RC1
RX3
RX4
TR2
R2
R1
TR1
RX1
RX2
L
BR

POWER CONTROL CIRCUIT ARRANGEMENTS

This invention relates to power control circuit arrangements. The present invention is more specifically concerned with circuit arrangements for controlling the a.c. power in a load by the use of power chopping techniques. More specifically the circuit arrangement to which the present invention is directed has application where the power available for the load exceeds that actually required and where automatic control of the required level of load power is needed in response to variations in the applied voltage and load resistance. For example, in the case of aircraft windshield heating arrangements, the resistance of the windshield heating element and the a.c. voltage normally available in the aircraft may provide for higher power being available than is in fact required.

According to the present invention therefore a direct current voltage proportional to the a.c. power applied to a load is derived from voltages proportional to the a.c. current flowing in the load and the a.c. voltage across the load, respectively, and compared with a voltage representing nominal power to the load to provide a d.c. signal the amplitude of which is utilised in conjunction with a staircase or ramp generator to add or deduct cycles of the a.c. power from the load circuit according to a predetermined load power rating and in dependence upon variations in the a.c. supply voltage to the load and changes in the resistance of the load.

In carrying out the invention the d.c. voltage proportional to the load current may be derived from a current transformer and rectification circuit with the primary of the transformer being connected in series with the load.

The d.c. voltage proportional to the load voltage may be derived from a transformer and rectifier circuit, the primary of the transformer being connected across part of a resistor chain itself connected across the load.

The d.c. voltage proportional to the load current is compared by a comparator with the sawtooth waveform output of a linear ramp generator and the d.c. voltage proportional to the load voltage is combined with the output from the comparator to produce a pulse train representative of the load current and voltage. This pulse train is then applied to an averaging circuit to produce a d.c. voltage proportional to the load power.

The latter d.c. voltage may then be compared in a comparator with a nominal power level voltage and a difference voltage output from the comparator applied to a further comparator for comparison with the staircase waveform produced by the aforesaid staircase waveform generator.

The output from the last-mentioned comparator may be applied to an ON/OFF control line of a thyristor control circuit in order to switch on or off a pair of thyristors which when conducting supply a.c. power to the load.

In one application especially envisaged the load comprises a windshield heating arrangement for aircraft.

By way of example an embodiment of the present invention will now be described with reference to the accompanying drawing which shows a circuit diagram of a circuit arrangement for controlling the power supplied to an aircraft windshield heating arrangement.

Referring to the drawing an aircraft windshield heater L defining a power load the resistance of which varies in dependence upon temperature is arranged to be supplied with a.c. power from the normally available aircraft supply (commonly 115 volts at 400 Hz) in response to the operation of thyristors TH1 and TH2.

The a.c. power which is normally available for heating purposes exceeds that which is required by the windshield heating arrangement and for the purpose of reducing the power available to the desired level and at the same time providing for control of the heating power in dependence upon variations in resistance of the heater and supply voltage, the circuit arrangement shown enables direct current voltages Vc and Vv which are proportional, respectively, to the current flowing through the heater and the voltage across the heater to be derived from the heating arangement. In this connection when the thyristors TH1 and TH2 are conducting during alternate half cycles of the supply to supply power to the heater L a voltage Vc proportional to the current flowing in the heater is provided by a current transformer TR1 the primary of which is in series with the heater L and the secondary of which is shunted by a burden resistor BR and is centre-tapped with the output therefrom being rectified by rectifiers RX1 and RX2 and smoothed by a resistor/capacitor network RC1. The direct current voltage Vc proportional to the heater current is applied to one input of a comparator COM1 the operation of which will be described later.

The heater L also has connected across it a resistor chain R1 and R2 with the primary of a transformer TR2 being connected across the resistor R2. The secondary of the transformer TR2 is centre-tapped and the transformer output is rectified by rectifiers RX3 and RX4 and smoothed by resistor/capacitor network RC2 to provide a direct current voltage Vv proportional to the a.c. voltage across the heater. This d.c. voltage Vv is applied to the output of the comparator COM1 referred to earlier.

As regards the operation of the power control circuit the power input to the circuit is derived from a low voltage (e.g. 12 volts) stabilised direct current supply circuit including resistor R3 capacitor C1 and zener diode Z1 and is derived from the normally available 28 volts d.c. aircraft supply.

The stabilised d.c. power supply drives a conventional linear ramp generator LRG the ramp output signal of which is applied to the inverting input of the comparator COM1. The non-inverting input to the comparator COM1 is the d.c. voltage Vc proportional to the a.c. load current and the voltage Vv is applied to the comparator output through resistor R5. As the comparator COM1 compares the d.c. voltage Vc with the ramp signal the comparator output will be at ground potential when the ramp signal voltage exceeds the d.c. voltage Vc and will go open circuit when the ramp signal voltage is below the d.c. voltage Vc. In the latter opencircuit condition of the comparator COM1 a pulse train will be produced the pulses of which have an amplitude proportional to the a.c. voltage across the heater and the mark-space ratio of which is proportional to the a.c. heater current.

This pulse train is applied to an averaging circuit including resistors R6 and R7 and capacitor C2 to produce a d.c. voltage level Vp which is proportional to the product of the d.c. voltages Vc and Vv proportional to the heater current and the heater voltage.

This average d.c. signal Vp is then amplified within comparator COM2 and compared with a preadjusted nominal power setting signal Vnp for the heater L applied to the inverting input of comparator COM2 from a potential divider circuit including resistors R7 and R8 and variable resistor R9. A difference output signal Vd which is applied to a resistor/capacitor network including resistor R10 and capacitor C3 which has a time constant of sufficient length to prevent interference by spurious signals and at the same time to hold the difference signal Vd for the the period during which power may be cut off from the heater L due to the cutting out of power cycles. The difference signal Vd is applied to one input of a further comparator COM3 and is compared therein against a staircase waveform applied to the other input of comparator COM3 from a staircase waveform generator SG. This generator is operated in accordance with pulses produced by a 400 Hz clock generator and applied to the control circuit for the thyristors TH1 and TH2. Thus each step of the staircase waveform from generator SG represents one cycle of the 400 Hz a.c. supply to the heater L. As the difference signal is compared with the staircase waveform the output of comparator COM3 goes to ground upon detecting a difference signal corresponding to a power level above a preadjusted nominal power setting for the heater and by so doing causes the a.c. power to the heater to be reduced by switching off the heater power for an appropriate number of cycles.

Referring now to the power control circuit the parallel-connected oppositely-poled thyristors TH1 and TH2 are arranged to be controlled for the purpose of controlling the average alternating current power supplied to the heater L from the a.c. supply.

The triggering of thyristors TH1 and TH2 to conduction is under the control of respective gating devices GA1 and GA2 each of which comprises a light-emitting diode in association with a photo-transistor. Each of these gating devices GA1 and GA2 is arranged to conduct to apply positive d.c. potential to the trigger electrode of its appertaining thyristor in response to energisation of the photo-emitting diode in response to a positive output from a latching device LA1 or LA2, as the case may be.

The operation of these latching devices LA1 and LA2 to provide positive outputs is dependent upon the polarity of the potential across the thyristors TH1 and TH2. For determining this polarity the circuit arrangement comprises two further light emitting diodes having associated photo-transistors connected in parallel and oppositely-poled relationship in series with a resistor R across the a.c. supply and defining gating devices GA3 and GA4. From a consideration of the circuit arrangment shown it will be seen that the gate GA4 will be opened when the "live" wire from the supply is positive with respect to "neutral" and the gate GA3 opens when the "live" wire is negative with respect to neutral. Thus the gate GA4 will be opened when the thyristor TH2 has a negative voltage across it and gate GA3 will be opened when thyristor TH1 has a negative voltage across it.

The outputs from the gates GA3 and GA4 are fed, respectively, to inputs of two further gating devices GA5 and GA6. These gating devices which are "AND" gates having their second inputs connected in common to a clock pulse generator (400 Hz) so that in the presence of clock pulses and earth (neutral) inputs these gates GA5 and GA6 will be opened to provide outputs for operating the respective latching devices LA2 and LA1, respectively, provided the latching devices are receiving an ON signal applied to them from the comparator COM3 when the difference voltage Vd is below the staircase nominal power setting signal. As previously mentioned, the outputs of the latching devices LA1, LA2 are arranged to open gates GA1 and GA2 respectively.

In operation of the arrangement, at the point of switching on of the arrangement both thyristors TH1 and TH2 will initially be in an un-triggered non-conducting condition.

The gating device GA3 or GA4 will be opened according to the polarity of the "live" wire of the supply. If it is positive with respect to "neutral" then the gating device GA4 will be opened and condition the gating device GA6 to open when a clock pulse is received as its other input as a consequence of which the output from the gate GA6 conditions latching device LA1 for opening when the ON/OFF control line is in the "ON" condition. Once operated, this latching device LA1 will remain latched open until the ON/OFF control line returns to the "OFF" condition. The latching device LA1 accordingly provides an output which opens gate GA1 which applies a positive triggering potential to the thyristor TH1. When the polarity of the voltage of the "live" wire changes from positive to negative the thyristor TH1 will fire immediately since it is already primed with a positive triggering voltage. At the same time the negative voltage on the "live" wire causes the gate GA3 to open which in turn causes the opening of the gate GA5 upon the occurrence of the next clock pulse. As gate GA5 opens it causes operation of latching device LA2 which is also conditioned to operate by the input signal applied to the ON/OFF line in its "ON" condition. Operation of the latching device LA2 effects opening of the gates GA2 and the application of positive potential to the trigger electrode of the thyristor TH2 so that the thyristor TH2 becomes primed ready to fire immediately the voltage on the "live" wire changes from negative to positive.

With this thyristor arrangement there is no delay at the time when the voltage changes to a polarity conducive to conduction of a thyristor and the application of the necessary positive triggering voltage to the thyristor, thereby avoiding the generation of radio frequency interference.

As will be appreciated from the foregoing description of one embodiment of the invention conduction of the thyristors which switch power to the heater L is controlled by the ON/OFF signal derived from the output of comparator COM3 in dependence upon the average power being supplied to the heater as compared with a preadjusted nominal power level or rating for the heater.

For the purpose of producing the requisite direct current voltage and power levels the following equations will be applied.

$$Vv = \frac{2\beta N}{\pi} Vac$$

$$\text{Where, } \beta = \frac{R2}{R2 + R1}$$

N = turns ratio (Ns)/(Np) of transformer TR2, and,
Vac = peak value of a.c. voltage across load L $$Vc = \frac{2Iac}{\pi\, n} R_B$$

where n=number of turns on current transformer TR1

$R_B$=value of burden resistor BR

Iac=peak value of ac load current.

Assuming output of comparator COM1 goes from 0 V to +12 V (i.e. Vs) the mark-space ratio of output is:

$$\frac{t}{T} = \frac{Vc}{Vs} = \frac{2Iac\ R_B}{\pi\ n\ Vs}$$

Average value of mark-space voltage limited waveform is:

$$Vp = \frac{Iac\ R_B}{n\ Vs}\left(\frac{2}{\pi}\right)^2 \beta.N.\ Vac$$

$$= \frac{R_B\ \beta N}{n\ Vs}\left(\frac{2}{\pi}\right)^2 Iac\ Vac$$

$$= \frac{R_B\ \beta N}{n\ Vs}\left(\frac{2}{\pi}\right)^2 Pav$$

Where Pav=average power assuming sinusoidal voltage and current equation for the Comparator COM2:

$$Vd = A\ (Vp - Vnp)$$

$$= \frac{ARB - \beta N}{n\ Vs}\left(\frac{2}{\pi}\right)^2 Pav - A\ Vnp$$

$$= \left(\frac{2R_B\ \beta N}{n\ Vs\ \pi^2}\ Pav - Vnp\right) A$$

If the staircase waveform from waveform generator SG goes from 0 V to Vs the average power to load L is:

$$Pav = \frac{Pinst \cdot Vd}{Vs}$$

Loop equation is therefore:

$$Pav = \left(\frac{2R_B\ BN.}{n\ Vs\ \pi_2}\ Pav - Vnp\right) \frac{Pinst.\ A}{Vs}$$

-continued $$Pinst = \frac{P\ peak}{2}$$

where P peak=peak power applied to load L $$Pav = \frac{A\ Pinst\ Vd.\ Vnp}{1 + \left(\frac{2R_B\ \beta N\ Pinst\ A}{Vs^2\ \pi^2}\right)}$$

$$= \frac{n\ Vs\ \pi^2\ Vnp}{2R_B\ \beta N}$$

It will be understood that the power control arrangement according to the present invention could be applied to many other alternating power consuming devices besides windshield heaters for aircraft.

What is claimed is:

1. A power control circuit arrangement for controlling the a.c. power in a load, comprising means for deriving a direct current voltage proportional to the a.c. power applied to said load from voltages proportional to the a.c. current flowing in the load and the a.c. voltage across the load, respectively; the voltage proportional to the load current is compared by a comparator with the sawtooth waveform output of a linear ramp generator and the voltage proportional to the load voltage is combined with the output from the comparator to produce a pulse train representative of the load current and voltage, the pulse train then being applied to an averaging circuit to produce said direct current voltage proportional to said a.c. power applied to the load; and means for comparing said direct current voltage with a voltage representing nominal power to the load to provide a d.c. signal the amplitude of which is utilised in conjunction with a staircase or ramp generator to add or deduct cycles of the a.c. power to or from the load circuit according to a predetermined load power rating and in dependence upon variations in the a.c. supply voltage to the load and changes in the resistance of the load.

2. A power control circuit arrangement as claimed in claim 1, in which the d.c. voltage proportional to the load power is compared by a comparator with a nominal power level voltage and a difference voltage output from the comparator applied to a further comparator for comparison with the staircase waveform produced by the aforesaid staircase generator.

3. A power control circuit arrangement as claimed in claim 2, in which the output from the said further comparator is applied to an ON/OFF control line of a thyristor control circuit in order to switch on or off a pair of thyristors through which a.c. power is arranged to be supplied to the load.

* * * * *